US011450967B2

(12) United States Patent
Tsuchiya

(10) Patent No.: US 11,450,967 B2
(45) Date of Patent: Sep. 20, 2022

(54) SLOT ANTENNA

(71) Applicant: YAZAKI CORPORATION, Tokyo (JP)

(72) Inventor: Kazuhiko Tsuchiya, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 17/336,594

(22) Filed: Jun. 2, 2021

(65) Prior Publication Data

US 2021/0384635 A1 Dec. 9, 2021

(30) Foreign Application Priority Data

Jun. 5, 2020 (JP) ..... JP2020-098427

(51) Int. Cl.
*H01Q 13/12* (2006.01)

(52) U.S. Cl.
CPC ..... *H01Q 13/12* (2013.01)

(58) Field of Classification Search
CPC ..... H01Q 13/12; H01Q 13/10; H01Q 13/18; H01Q 1/3275; H01Q 1/32
See application file for complete search history.

(56) References Cited

U.S. PATENT DOCUMENTS 2,611,865 A 9/1952 Alford
6,304,227 B1 * 10/2001 Hill ..... H01Q 13/10 343/769

FOREIGN PATENT DOCUMENTS

GB 648262 A 1/1951
JP 5-136627 A 6/1993
JP 4814271 B2 11/2011

* cited by examiner

*Primary Examiner* — Hoang V Nguyen
(74) *Attorney, Agent, or Firm* — Sughrue Mion, PLLC

(57) ABSTRACT

A slot antenna is provided with a metal cylindrical antenna element. The antenna element is formed at a height of λ/4 or less when λ is a wavelength of an antenna frequency to be used. Further, the antenna element has a slot for vertical polarization having a length of λ/2 or more in a circumferential direction.

3 Claims, 4 Drawing Sheets

SLOT ANTENNA

CROSS REFERENCE TO RELATED APPLICATION

This application is based upon and claims the benefit of priority under 35 U.S.C. § 119 from Japanese Patent Application No. 2020-098427 filed on Jun. 5, 2020, the entire contents of which are incorporated herein by reference.

TECHNICAL FIELD

The present application relates to a slot antenna capable of transmitting and receiving a vertical polarization.

BACKGROUND

Japanese Patent Application Laid-Open No. H5 (1993)-136627 discloses a slot antenna having a cylindrical metal body whose length in the axial direction is less than λ/4 when λ is a wavelength of an electromagnetic wave to be used.

SUMMARY

However, in the slot antenna, since end plates having a diameter larger than that of the cylindrical body are fixed to both end portions of the cylindrical body, it is difficult to reduce the size and height of the slot antenna, and the cost thereof is also high.

An object of the present application is to provide a slot antenna suitable for use as an on-vehicle antenna which can be made compact, low in height and low in cost, and which can make radiation characteristics in vertical polarization omnidirectional in a horizontal plane.

A slot antenna according to an embodiment is provided with a metal cylindrical antenna element, wherein the antenna element is formed at a height of λ/4 or less when λ is a wavelength of an antenna frequency to be used, and the antenna element has a slot for vertical polarization having a length of λ/2 or more in a circumferential direction.

It is preferable that the slot is formed along a circumferential direction at a center position of the height of the antenna element.

It is preferable that the antenna element has a ceiling surface.

It is preferable that the antenna element is made of a conductive metal and formed in a true cylindrical shape.

It is preferable that the antenna element is made of a conductive metal and formed into an elliptical cylindrical shape.

According to the above configuration, it is possible to provide a slot antenna suitable for use as an on-vehicle antenna which can be made compact, low in height and low in cost, and which can make radiation characteristics in vertical polarization omnidirectional in a horizontal plane.

DETAILED DESCRIPTION

A slot antenna according to an embodiment of the present application will be described in detail below with reference to the drawings.

Figure 1:
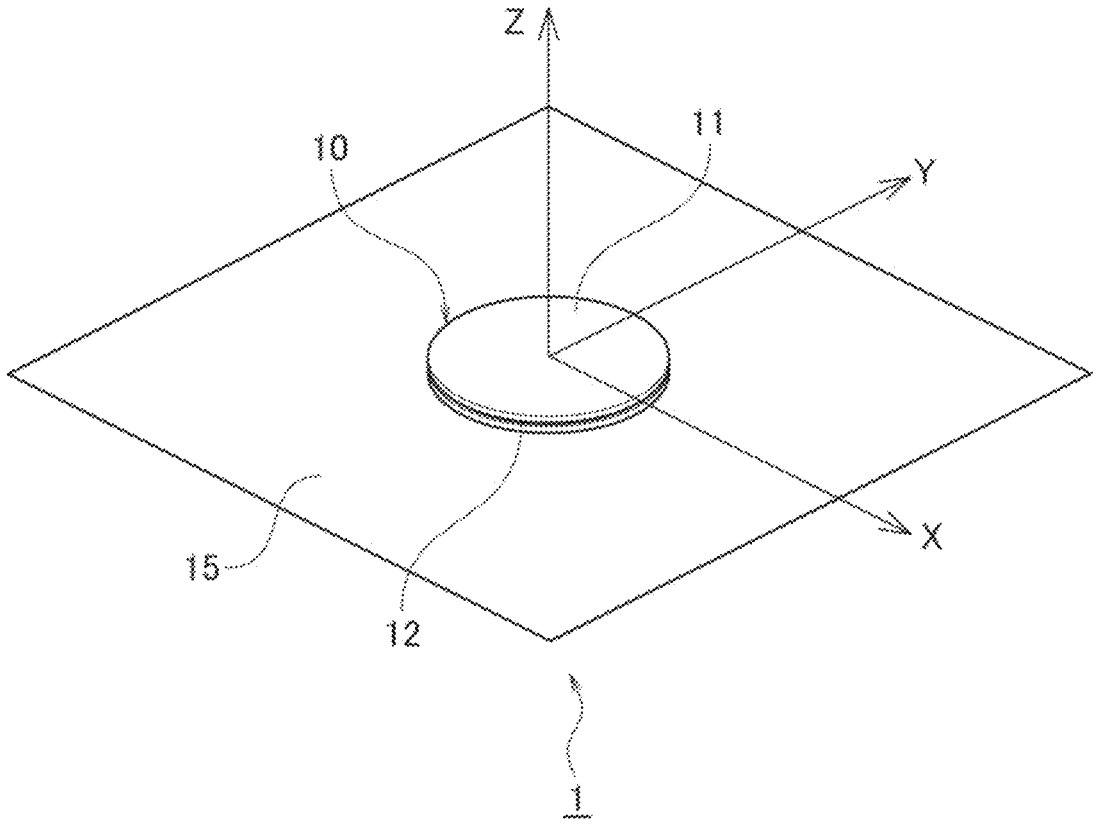
FIG. 1 is a perspective view showing a slot antenna according to a first embodiment of the present application.
Figure 2:
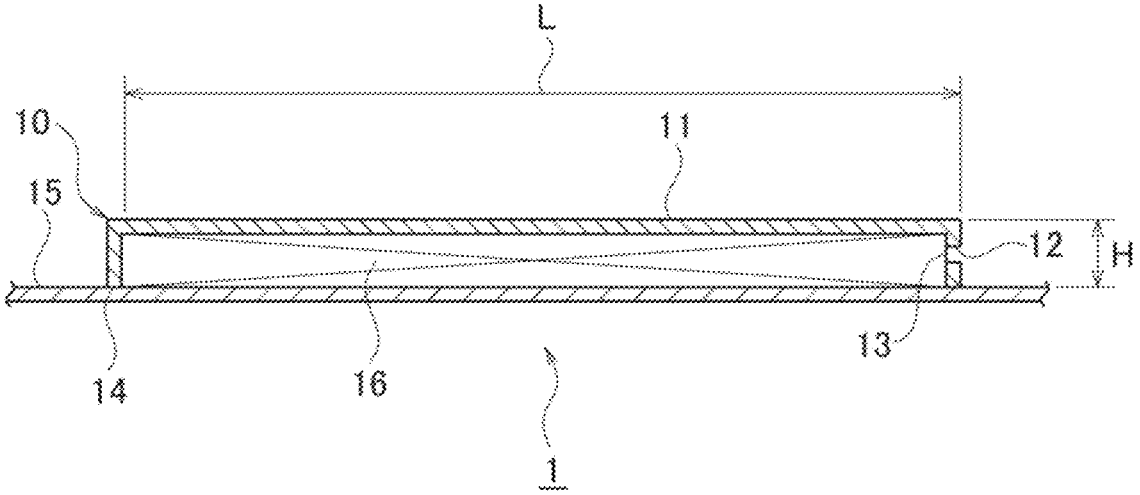
FIG. 2 is a side sectional view of the slot antenna.

As shown in FIGS. 1 and 2, a slot antenna 1 includes a metal cylindrical antenna element 10, a ground plane 15 as a ground plane and a dielectric 16, and is suitable for use as an on-vehicle antenna.

Figure 3:
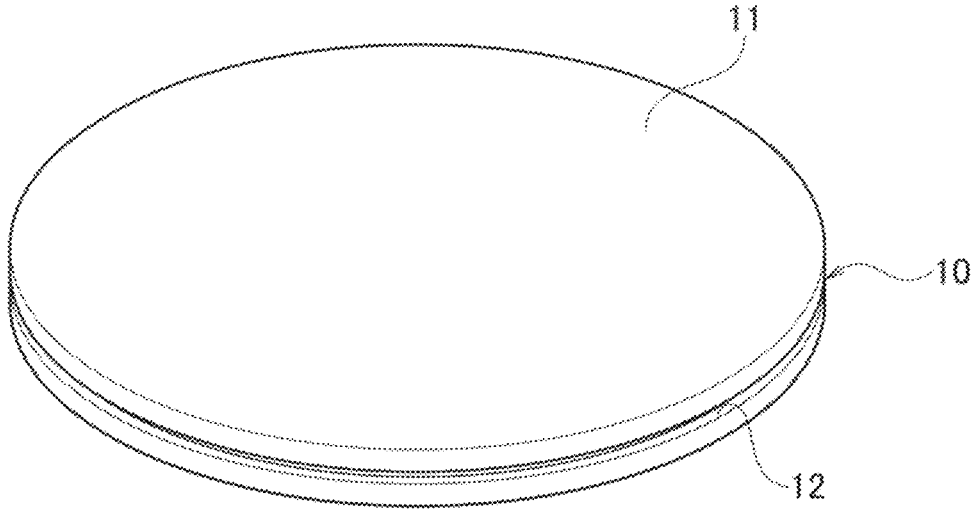
FIG. 3 is an enlarged perspective view of an antenna element of the slot antenna.

As shown in FIGS. 2 and 3, the antenna element 10 is a thin, true (straight) cylindrical shape made of a conductive material, for example, a metal such as copper or iron. An upper end (upper Z direction in FIG. 1) of the thin and true cylindrical antenna element 10 has a ceiling surface 11 of a true circular plate shape. Further, the antenna element 10 is formed at a height H of λ/4 or less when λ is a wavelength of an antenna frequency (electromagnetic wave) to be used.

As shown in FIGS. 2 and 3, the antenna element 10 has a vertically polarized notch (slot) 12 having a length L of λ/2 or more in the circumferential direction. The notch 12 is formed along a circumferential direction at a center position above and below (Z direction in FIG. 1) the antenna element 10. Then, as shown in FIG. 2, power is supplied at a power feeding point 13 at the center of the notch 12. The antenna element 10 is connected to a ground plane 15 in a DC manner at a grounding point 14 on the 180 degrees opposite side of the power feeding point 13.

When the slot antenna 1 is installed on a vehicle (omitted) such as a vehicle roof, the ground plane 15 is installed on the vehicle roof or the like. In this case, the vehicle roof or the like may also be used as the ground plane 15. An inner cavity of the thin and true cylindrical antenna element 10 is provided with a dielectric 16 for the purpose of securing strength and reducing the size of the antenna element 10, but even without the dielectric 16, it is possible to function as an antenna by adjusting the length L of the notch 12 to λ/2 or more.

According to the slot antenna 1 of the first embodiment, the notch 12, which is provided at the center position of the thin and true cylindrical antenna element 10 with a length of λ/2 or more along the circumferential direction, acts as an on-vehicle antenna at a desired frequency.

Figure 4:
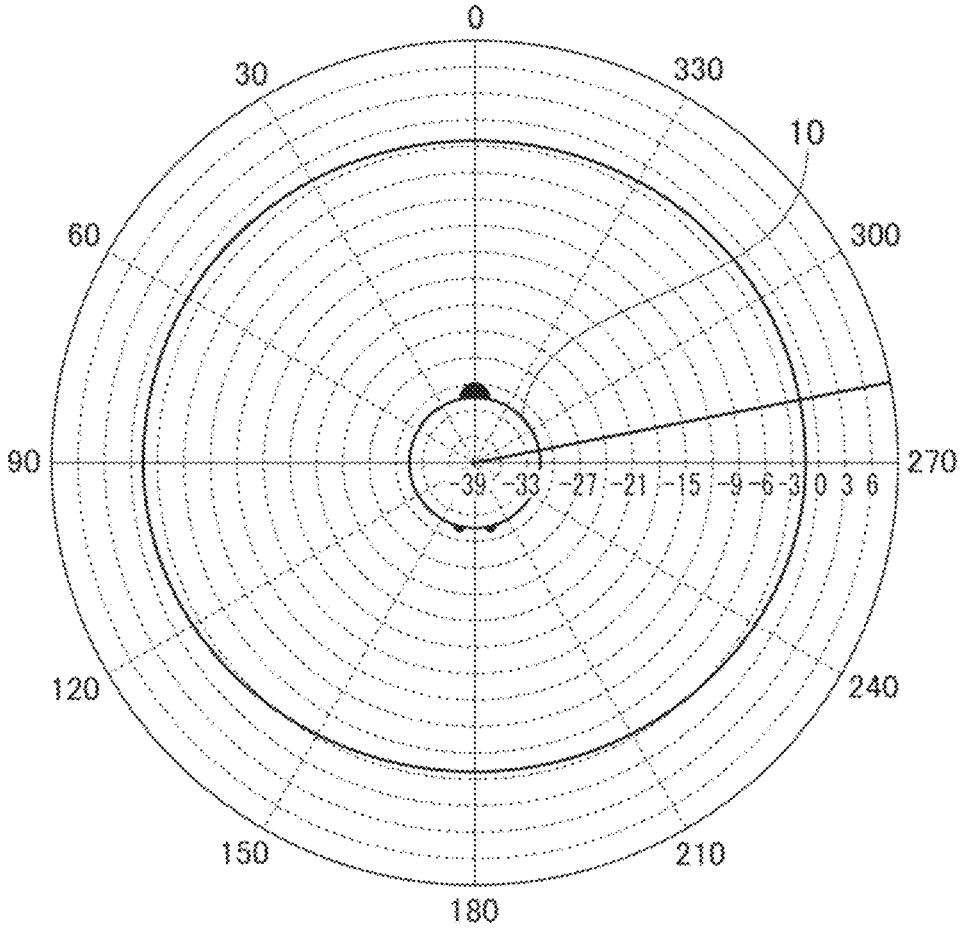
FIG. 4 is a radiation characteristic diagram of the slot antenna in a horizontal plane.
Figure 5:
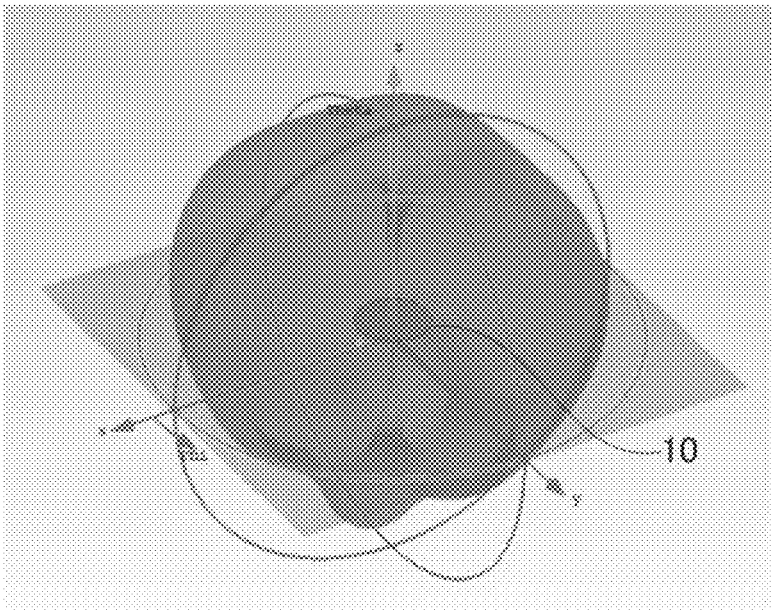
FIG. 5 is a three-dimensional radiation characteristic diagram of the slot antenna.

Further, as shown in FIGS. 4 and 5, it is possible to radiate a vertical polarization (V polarization) non-directionally on the horizontal plane (XY plane) of the slot antenna 1 from the notch 12 provided along the circumferential direction with a length of λ/2 or more at the center position of the thin and true cylindrical antenna element 10.

In this way, by making the length L of the notch 12 formed along the circumferential direction in the thin and true cylindrical antenna element 10 longer than 212, the inductance component is increased and the antenna can be matched (Impedance matching is performed). Therefore, upper and lower end plates which are metal plates for impedance matching as in the prior art are not required, and accordingly, the slot antenna 1 can be reduced in size, height and cost, and radiation characteristics in vertical polarization can be made omnidirectional in a horizontal plane. As a result, the slot antenna 1 having a small size and a low height is suitable for use as an on-vehicle antenna.

Figure 6:
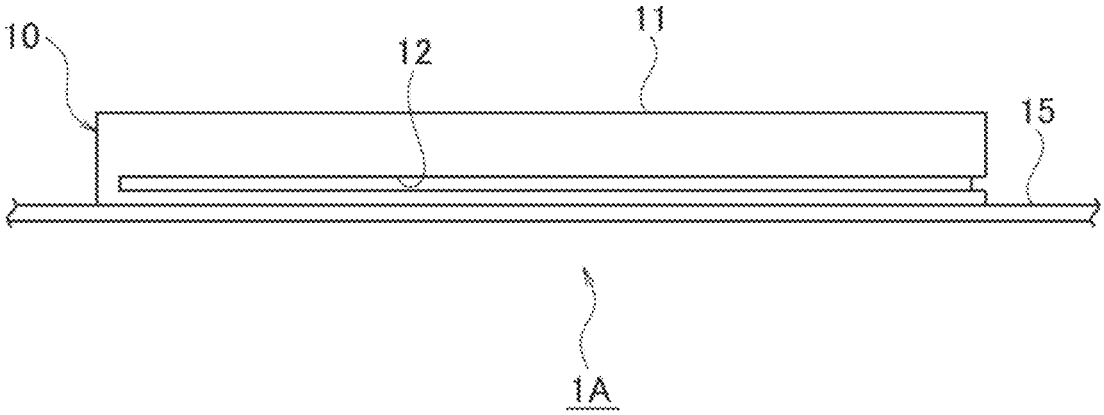
FIG. 6 is a side view showing a slot antenna according to a second embodiment of the present application.

FIG. 6 is a side view showing a slot antenna according to a second embodiment of the present application.

The slot antenna 1A of the second embodiment differs from that of the first embodiment in that the slot 12 is formed to have a length of λ/2 or more along the circumferential direction at a position lower than the center in the Z direction in FIG. 1 of the true cylindrical antenna element 10. Since the other components are the same as those of the first embodiment, the same components are denoted by the same reference numerals and detailed description thereof is omitted.

In the slot antenna 1A of the second embodiment, the slot 12 is formed to have a length of λ/2 or more along the circumferential direction at a position lower than the center of the true cylindrical antenna element 10, so that the same operation and effect as in the first embodiment can be obtained.

Figure 7:
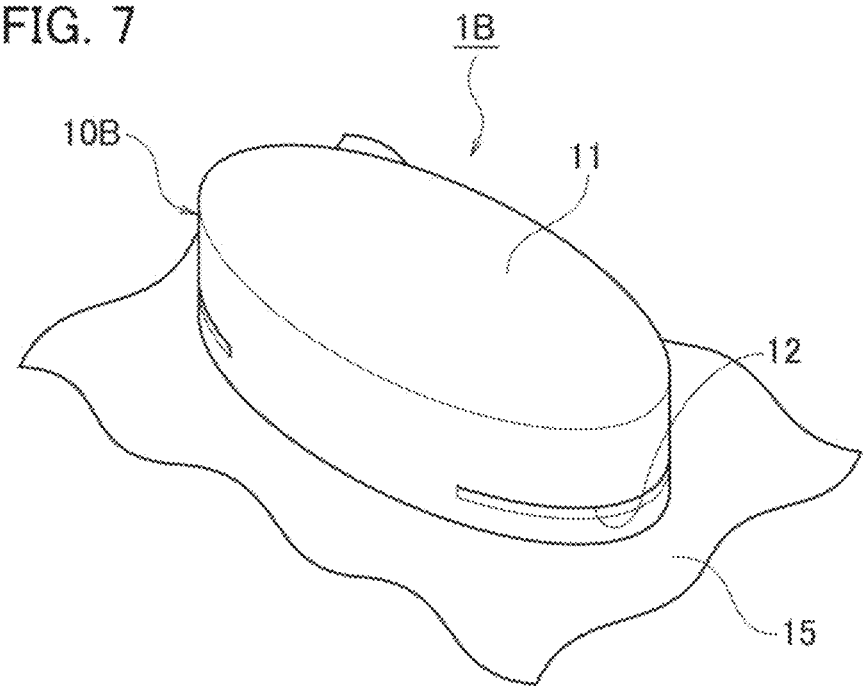
FIG. 7 is a perspective view showing a slot antenna according to a third embodiment of the present application.
Figure 8:
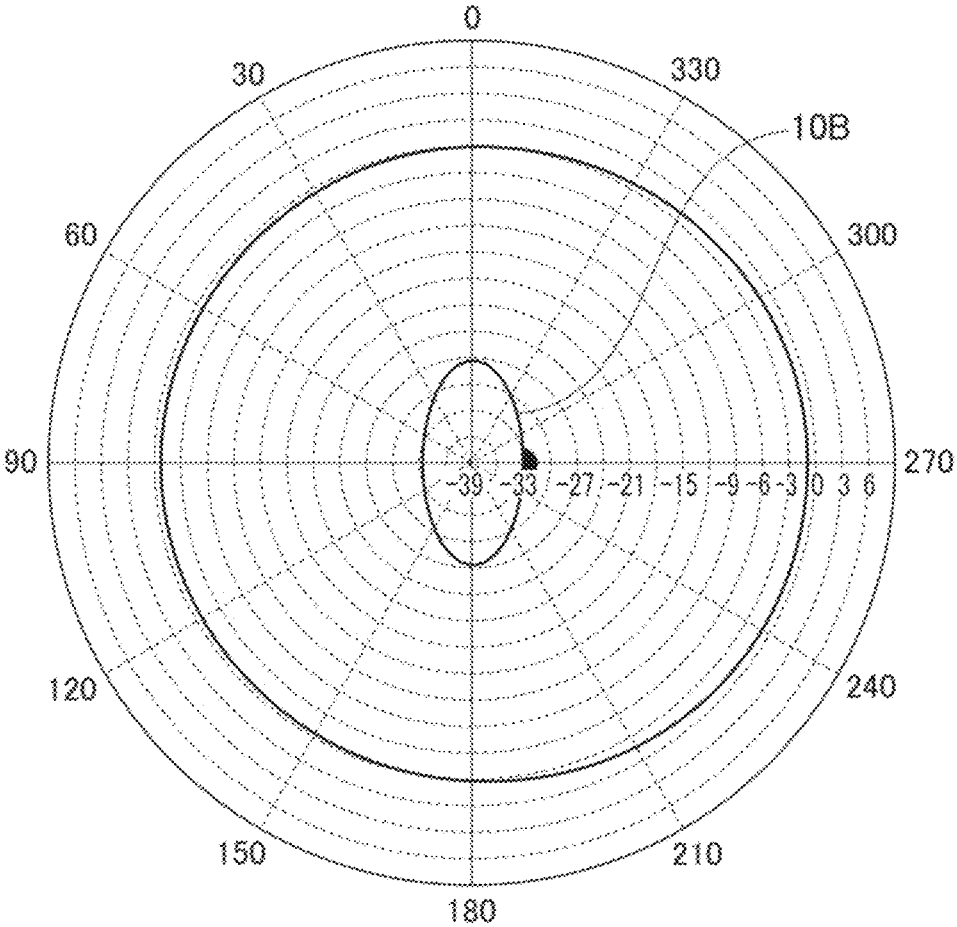
FIG. 8 is a radiation characteristic diagram of the slot according to a third embodiment in a horizontal plane.

FIG. 7 is a perspective view showing a slot antenna according to a third embodiment of the present application. FIG. 8 is a radiation characteristic diagram of a slot antenna in a horizontal plane.

A slot antenna 1B of the third embodiment differs from that of the first embodiment in that an antenna element 10B is formed in an elliptical cylindrical shape having an aspect ratio of 2 to 1, and the slot 12 is formed at a position lower than the center in the Z direction in FIG. 1. Since the other components are the same as those of the first embodiment, the same components are denoted by the same reference numerals and detailed description thereof is omitted.

In the slot antenna 1B of the third embodiment, the antenna element 10B is formed in an elliptical cylindrical shape, and the slot 12 is formed with a length of λ/2 or more along the circumferential direction at a position lower than the center of the antenna element 100, so that the same operation and effect as those of the first embodiment are achieved.

Next, a comparative example will be described. The slot antenna according to the comparative example is provided with a cylindrical metal body whose length in the axial direction is less than λ/4 when λ is the wavelength of the electromagnetic wave to be used.

In the cylindrical body of the slot antenna according to the comparative example, a notch having a length of λ/2 is formed in the circumferential direction. Further, end plates made of a conductive material having a diameter larger than that of the cylindrical body are fixed to both ends of the cylindrical body. By setting the axial direction of the cylindrical body to the vertical direction, a vertically polarized omnidirectional antenna can be realized.

However, in the slot antenna according to the comparative example, since end plates having a diameter larger than that of the cylindrical body are fixed to both ends of the cylindrical body, it is difficult to reduce the size and height of the slot antenna, and the cost thereof is also high.

Although the present embodiment has been described above, the present embodiment is not limited thereto, and various modifications can be made within the scope of the gist of the present embodiment.

That is, according to each embodiment, the cylindrical antenna element has a ceiling surface, but may be simply cylindrical without the ceiling surface.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A slot antenna comprising a metal cylindrical antenna element, wherein the antenna element is formed at a height of λ/4 or less when λ is a wavelength of an antenna frequency to be used, the antenna element has a slot for vertical polarization having a length of λ/2 or more in a circumferential direction, and the antenna element is made of a conductive metal and formed into an elliptical cylindrical shape having an oval cross-section different from a circular cylindrical shape.

2. The slot antenna according to claim 1, wherein the slot is formed along a circumferential direction at a center position of the height of the antenna element.

3. The slot antenna according to claim 1, wherein the antenna element has a ceiling surface.

* * * * *